US006919757B2

(12) United States Patent
Sakurai

(10) Patent No.: US 6,919,757 B2
(45) Date of Patent: Jul. 19, 2005

(54) VOLTAGE REGULATOR WITH TURN-OFF ASSIST

(75) Inventor: Atsushi Sakurai, Chiba (JP)

(73) Assignee: Seiko Instruments Inc., Chiba (JP)

( * ) Notice: Subject to any disclaimer, the term of this patent is extended or adjusted under 35 U.S.C. 154(b) by 314 days.

(21) Appl. No.: 10/253,753

(22) Filed: Sep. 24, 2002

(65) Prior Publication Data

US 2003/0090250 A1 May 15, 2003

(30) Foreign Application Priority Data

Nov. 9, 2001 (JP) ..... 2001-345242

(51) Int. Cl.[7] ..... G05F 1/10

(52) U.S. Cl. ..... 327/541; 327/543; 327/544; 323/316

(58) Field of Search ..... 327/538, 540, 327/541, 543, 544; 323/313, 315, 316

(56) References Cited

U.S. PATENT DOCUMENTS 5,194,762 A * 3/1993 Hara et al. ..... 327/537
5,335,203 A * 8/1994 Ishii et al. ..... 365/226
6,011,428 A * 1/2000 Tsukude et al. ..... 327/541
6,650,097 B2 * 11/2003 Sakurai ..... 323/279

* cited by examiner

*Primary Examiner*—Terry D. Cunningham
(74) *Attorney, Agent, or Firm*—Adams & Wilks

(57) ABSTRACT

To provide a voltage regulator capable of securely being turned off even if the regulator is used under a high temperature and an impedance of an external load is large. A voltage regulator is provided, which includes a voltage divider circuit that can divide a potential difference between an output voltage terminal and a reference terminal, wherein when the voltage divider circuit inputs an on signal, the voltage divider circuit outputs a constant voltage between the output voltage terminal and the reference terminal, and wherein when the voltage divider circuit inputs an OFF signal, the voltage divider circuit can reduce the impedance thereof.

3 Claims, 3 Drawing Sheets

VOLTAGE REGULATOR WITH TURN-OFF ASSIST

BACKGROUND OF THE INVENTION

1. Field of the Invention

The present invention relates to a voltage regulator.

2. Description of the Related Art

A conventional voltage regulator will be described with reference to the accompanying drawings.

FIG. 2 is a circuit block diagram showing the structural example of a conventional voltage regulator.

As shown in FIG. 2, a voltage regulator 201 includes external terminals consisting of an input voltage terminal 102, a GND terminal 103, an output voltage terminal 104, and an on/off terminal 110. The voltage regulator 201 also includes a reference voltage circuit 105 that can output a constant voltage, a voltage divider circuit 206 that can divide the voltage of the output voltage terminal 104 at an appropriate ratio, an error amplifier circuit 107 that can adjust an output voltage by comparing two input voltages with each other, an output circuit 108 that can adjust an impedance, a logic circuit 109 that can control the operation of the reference voltage circuit 105 and the error amplifier circuit 107. In FIG. 2, the voltage divider circuit 206 is made up of a resistor 221 and a resistor 222.

Upon inputting an ON signal from the on/off terminal 110, the logic circuit 109 sends a signal to the reference voltage circuit 105 and the error amplifier circuit 107, and makes the output circuit 108 adjust the impedance so that the error amplifier circuit 107 keeps the input voltage from the voltage divider circuit 206 so as to be equal to the input voltage from the reference voltage circuit 105. Therefore, the voltage regulator 201 can keep the output voltage terminal 104 to a constant voltage even if the input voltage fluctuates.

On the other hand, upon inputting an off signal from the on/off terminal 110, the logic circuit 109 sends a signal to the reference voltage circuit 105 and the error amplifier current 107, and adjusts the error amplifier circuit 107 so that the impedance of the output circuit 108 becomes larger. Therefore, the voltage of the output voltage terminal 104 is pulled down to the GND terminal 103 through the impedance of the voltage divider circuit 206, and the voltage regulator 201 can keep the voltage of the GND terminal 103.

The output voltage terminal 104 is connected with various external loads 111 such as a CPU or a microcomputer depending on an intended use. Also, in order to stabilize the voltage of the output voltage terminal 104, the voltage regulator 201 is normally connected with an output capacitor 112 in use.

As described above, in the conventional voltage regulator 201, when the signal is in an off-state, the output voltage terminal 104 is pulled down to the GND terminal 103 through the impedance of the voltage divider circuit 206. Accordingly, in the case where the leak current of the output circuit 108 becomes large due to such conditions that the impedance of the external load 111 becomes large and the temperature of an IC becomes high, the voltage of the output voltage terminal 104 is not pulled down to the voltage of the GND terminal 103. As a result, there arises such a problem that the voltage regulator 201 cannot be turned off.

A simple example in which the leak current of the output circuit 108 becomes large due to such conditions that the impedance of the external load 111 becomes large and the temperature of an IC becomes high will be described.

When the signal is in an off-state, the voltage of the output voltage terminal 104 is represented by the following expression (1).

$$VOUT = ILEAK \times (ROUT1 // ROUT2) \quad (1)$$

where VOUT is a voltage (V) of the output voltage terminal 104, ILEAK is a leak current (A) of the output circuit 108, ROUT1 is an impedance (Ω) of the voltage divider circuit 206, ROUT 2 is an impedance (Ω) of the external load 111, and (ROUT1//ROUT2) is a composite impedance (Ω) of the ROUT1 and ROUT2 in parallel.

For example, in the case where ILEAK=1 μA (the value of the maximum presumed leak current), ROUT=3 MegΩ, and ROUT2=∞, the following expression is satisfied from the expression (1).

$$VOUT = 1\ uA \times 3\ Meg\Omega = 3\ V \quad (2)$$

In this example, in the case where the output voltage of the voltage regulator 201 is 3 V, in both on and off-states, the same voltage is obtained in the above case. That is, the voltage regulator cannot be turned off.

When the voltage regulator 201 cannot be turned off, the external load 111 continues to consume a power wastefully. That is, there arises such a problem that the power consumption of a system using the conventional voltage regulator 201 increases.

SUMMARY OF THE INVENTION

The present invention has been made to eliminate the above problem with the conventional art, and therefore an object of the present invention is to provide a voltage regulator that does not consume the useless power.

To achieve the above object, according to the present invention, there is provided a voltage regulator which is capable of decreasing the impedance of a voltage divider circuit in accordance with a signal from a logic circuit when the voltage regulator is going to turn off, and of pulling down an output voltage terminal to a GND terminal.

In the voltage regulator according to the present invention, a voltage divider circuit whose impedance becomes small when an off signal is sent from the logic circuit is provided. As a result, the pull-down of the output voltage terminal when the voltage regulator turns off becomes strong. Therefore, even if the leak current of the output circuit becomes large due to a high temperature, and the impedance of the external load is large, the voltage of the output voltage terminal can be pulled down to the vicinity of the voltage of the GND terminal to turn off the voltage regulator.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the present invention with reference to the accompanying drawings.

Figure 1:
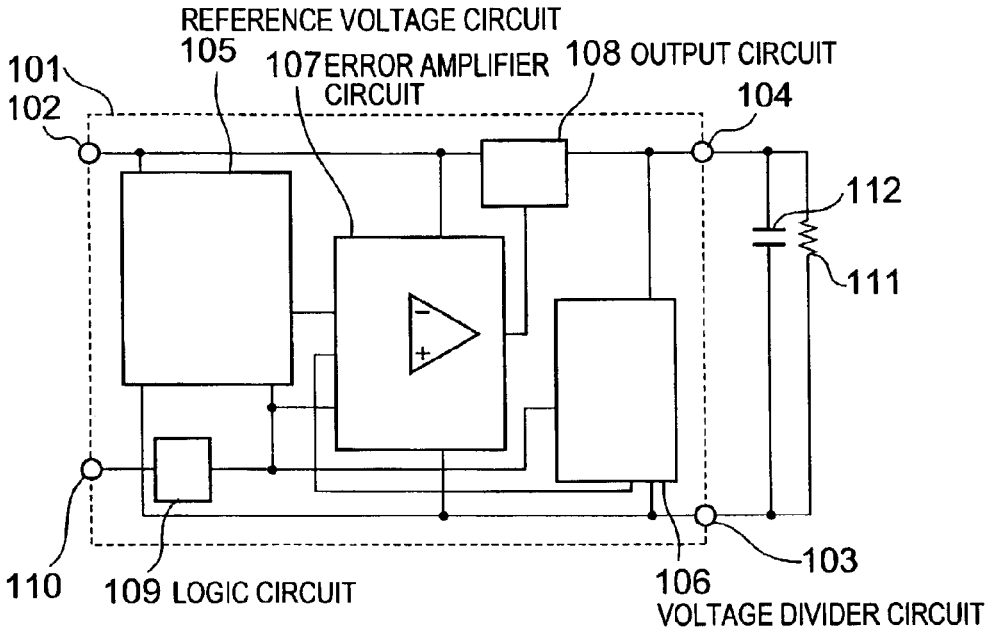
FIG. 1 is a circuit block diagram showing one structural example of a voltage regulator in accordance with the present invention.
Figure 2:
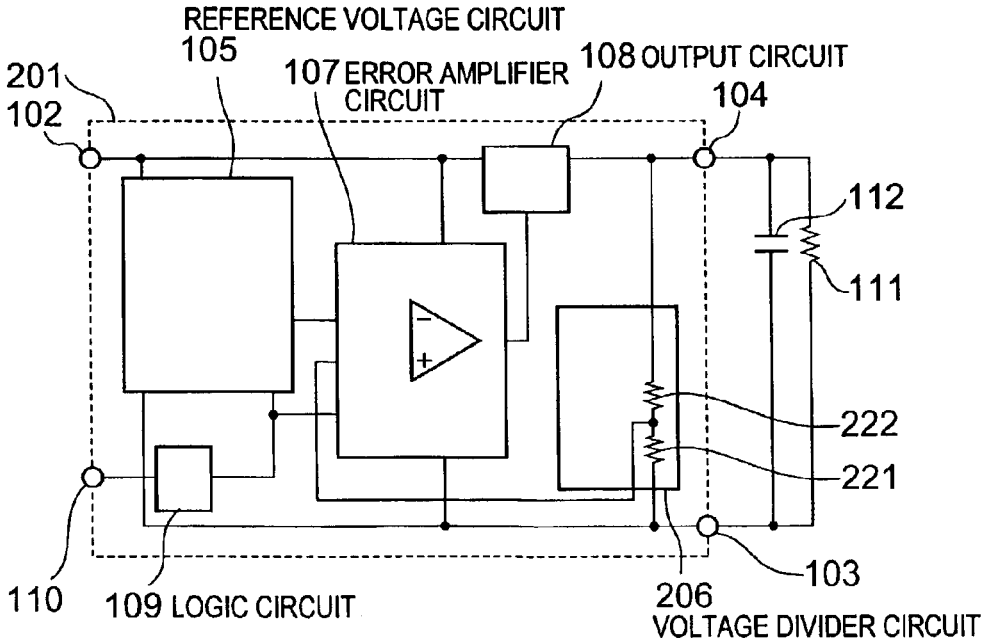
FIG. 2 PRIOR ART
FIG. 2 is a circuit block diagram showing a structural example of a conventional voltage regulator.

FIG. 1 is a circuit block diagram showing one structural example of a voltage regulator in accordance with the present invention. In a voltage regulator 101, the conventional voltage divider circuit 206 is replaced by a voltage divider circuit 106. Other structural elements are identical with those in the conventional voltage regulator shown in FIG. 2.

Upon inputting a signal which is outputted from a logic circuit 109 in response to an on/off signal which is inputted to an on/off terminal 110, the voltage divider circuit 106 can vary an impedance ROUT1. In the case where an on signal is inputted to the on/off terminal 110, the voltage divider circuit 106 increases an impedance thereof, divides a voltage of an output voltage terminal 104 at an appropriate ratio and outputs the divided voltage to an error amplifier circuit 107. In this way, the voltage regulator 101 outputs a constant voltage to the output voltage terminal 104.

On the other hand, in the case where an off signal is inputted to the on/off terminal 110, the voltage divider circuit 106 decreases the impedance thereof and can pull down the output voltage terminal 104 to the GND terminal 103. In this case, for example, the impedance ROUT1 of the voltage divider circuit 106 is so set as to become smaller to 3 KΩ.

In this case, even if a leak current of 1 $\mu$A occurs in the output circuit 108 as in the conventional art, the following expression is satisfied from the expression (1).

$$VOUT=1\ uA\times 3\ K\Omega=3\ mV \quad (3)$$

That is, the voltage regulator 101 can be kept in an off-state of off even if the leak current of the output circuit 108 becomes large because of a high temperature, and the impedance of an external load 111 is large.

In this example, the off state may not always correspond to the voltage per se of the GND terminal 103. The voltage maybe lower than the operating voltage of a microcomputer or the like which is connected as the external load 111, and are varied depending on the intended use. From the viewpoint of a general-purpose product, if the voltage is set to 100 mV or lower, since an IC which is connected as the external load 111 does not operate except for a specific case, the voltage regulator 101 is satisfactorily off. Therefore, 3 mV in the expression (3) is sufficiently off.

As described above, the voltage regulator 101 according to the present invention can turn off without any problems even if the voltage regulator 101 is used under the circumstances in which the temperature is high, and the impedance of the external load 111 is large. For that reason, during off operation, the external load 111 does not consume the power more than necessary, and the saving of the power consumption of a system using the voltage regulator 101 is realized.

In this example, the impedance of the voltage divider circuit 106 during the off state can be freely set in accordance with the respective intended uses even if the external load 111 or the output capacitor 112 are changed. Also, if the voltage divider circuit 106 is so structured as to reduce the impedance during the off state, the effects of this embodiment can be achieved regardless of the internal circuit structure.

Subsequently, a first structural example of the voltage divider circuit in the voltage regulator will be described in detail.

Figure 3:
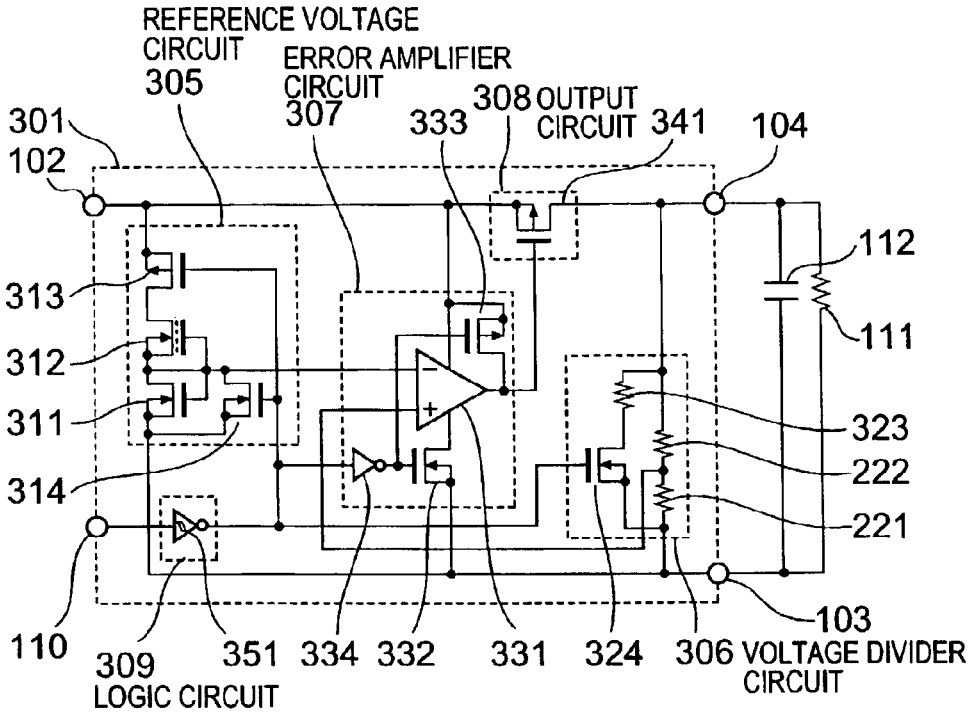
FIG. 3 is a circuit block diagram showing another structural example of a voltage regulator in accordance with the present invention.

FIG. 3 is a circuit block diagram showing the structural example of a voltage regulator in accordance with the present invention.

In a voltage regulator 301, the reference voltage circuit 105 is replaced by a reference voltage circuit 305, the voltage divider circuit 106 is replaced by a voltage divider circuit 306, the error amplifier circuit 107 is replaced by an error amplifier circuit 307, the output circuit 108 is replaced by an output circuit 308, and the logic circuit 109 is replaced by a logic circuit 309, respectively. Other structural elements are identical with the voltage regulator shown in FIG. 1 although their reference numerals are different therebetween in the foregoing manner.

The logic circuit 309 is made up of an inverter 351 having a hysteresis characteristic. When the voltage (hereinafter referred to as "Hi") of the input voltage terminal 102 is inputted to the on/off terminal 110 as the on signal, the logic circuit 309 outputs the voltage (hereinafter referred to as "Lo") of the GND terminal 103.

On the other hand, when Lo is inputted to the on/off terminal 110 as the off signal, the logic circuit 309 outputs Hi.

The reference voltage circuit 305 outputs a constant voltage by using an enhancement NMOS transistor 311 and a depletion NMOS transistor 312. An enhancement PMOS transistor 313 and an enhancement NMOS transistor 314 receive a signal from the logic circuit 309, and through the input of Lo which is the on signal, the enhancement PMOS transistor 313 turns on and the enhancement NMOS transistor 314 turns off, and therefore a constant voltage is outputted from the reference voltage circuit 305.

On the other hand, through the input of Hi which is the off signal, the enhancement PMOS transistor 313 turns off and the enhancement NMOS transistor 314 turns on, and therefore the Lo is outputted from the reference voltage circuit 305.

The error amplifier circuit 307 is made up of an error amplifier 331, an enhancement NMOS transistor 332, an enhancement PMOS transistor 333, and an inverter 334. The inverter 334 receives a signal from the logic circuit 309, and when the inverter 334 receives Lo which is the on signal, the inverter 334 outputs Hi, the enhancement NMOS transistor 332 turns on and the enhancement PMOS transistor 333 turns off, and therefore the error amplifier 331 adjusts the impedance of the output circuit 308 so as to keep the output voltage from the reference voltage circuit 305 and the output voltage from the voltage divider circuit 306 to be equal to each other. As a result, a constant voltage is outputted from the output voltage terminal 104 not depending on the input voltage terminal 102.

On the other hand, upon inputting Hi which is the off signal in the inverter 334, it outputs Lo, the enhancement NMOS transistor 332 turns off and the enhancement PMOS transistor 333 turns on, and therefore the error amplifier 331 becomes in a standby state where the power consumption is suppressed, and the output of the error amplifier circuit 307 is pulled up to Hi. Because the output circuit 308 is made up of the enhancement PMOS transistor 341, when Hi is inputted to the output circuit 308, the impedance of the output circuit 308 becomes high. As a result, the output voltage terminal 104 is pulled down to Lo due to the voltage divider circuit 306.

In the voltage divider circuit 3065, a resistor 323 which is a second resistor and an enhancement NMOS transistor 324 are added so as to be connected to the voltage divider circuit 206 in parallel with each other. The enhancement NMOS transistor 324 receives a signal from the logic circuit 309, and upon inputting Lo which is the off signal for the enhancement NMOS transistor 324, it turns off, and the impedance ROUT1 of the voltage divider circuit 306 becomes large so that the voltage of the output voltage terminal 104 can be divided at the ratio of the resistor 221 which is the first resistor and the resistor 222.

On the other hand, upon inputting Hi which is the on signal in the enhancement NMOS transistor 324, it turns on, and the impedance ROUT1 of the voltage divider circuit 306 becomes (resistor 221+resistor 222)//resistor 323. At this time, if the impedance of the resistor 323 is set to be sufficiently smaller than the resistor 221+the resistor 222, the impedance ROUT1 of the voltage divider circuit 306 can be regarded substantially as the impedance of the resistor 323. For example, in the case where the high-temperature leak current of the output circuit 308 is 1 uA, and the resistor 221+the resistor 222 are 3 MegΩ, and the resistor 323 is 3 KΩ, the voltage regulator 301 can be pulled down to 3 mV substantially similar to the expression (3) at the time of turning off.

Therefore, even if the leak current of the output circuit 308 becomes large at a high temperature, and the impedance of the external load 111 is large, it is possible that the voltage regulator 301 according to this embodiment keeps the off state.

Also, since the resistor 323 is located, the value of current that flows from the output capacitor 112 to the enhancement NMOS transistor 324 at the time of turning off can be adjusted. Therefore, it is possible to prevent the enhancement NMOS transistor 324 from being broken by allowing a large current to flow as soon as the voltage regulator 301 turns off.

Also, the impedance of the resistor 323 and the output capacitor 112 are adjusted so that a speed at which the voltage regulator 301 turns off can be adjusted. Thus, the present invention can be adapted to various applications.

In this example, as shown in FIG. 3, the resistor 323 is connected between the drain terminal of the enhancement NMOS transistor 324 and the output voltage terminal 104, but the same effects can be obtained if the resistor 323 is disposed between the output voltage terminal 104 and the GND terminal 103 and connected in series to the enhancement NMOS transistor 324.

Even if the reference voltage circuit 305 and the error amplifier circuit 307 are structured by other circuits that execute the same operation, the effects of the present invention can be obtained.

Subsequently, a second structural example of the voltage divider circuit of the voltage regulator in accordance with this embodiment will be described in detail.

Figure 4:
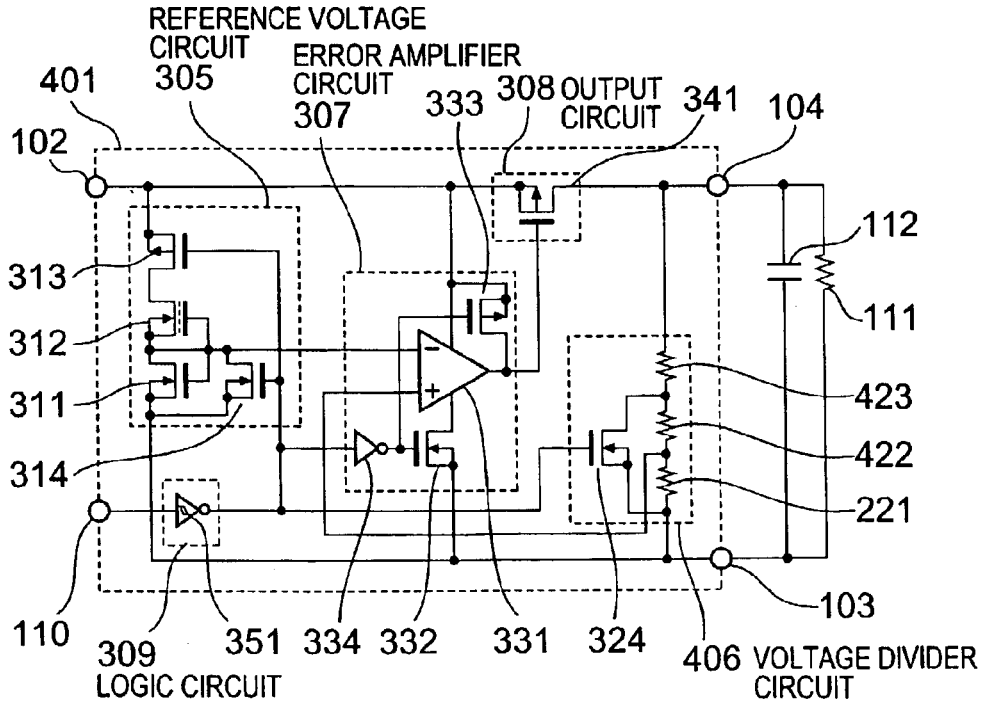
FIG. 4 is a circuit block diagram showing still another structural example of a voltage regulator in accordance with the present invention.

FIG. 4 is a circuit block diagram showing still another structural example of a voltage regulator in accordance with the present invention.

In a voltage regulator 401, the voltage divider circuit 306 is replaced by a voltage divider circuit 406. Other structural elements are identical with those of the voltage regulator shown in FIG. 3.

In the voltage divider circuit 406, the resistor 222 and the resistor 323 are replaced by a resistor 422 and a resistor 423 which is a fourth resistor, and the drain terminal of the enhancement NMOS transistor 324 is connected between the resistor 422 and the resistor 423. In this example, the resistor 422 and the resistor 221 are called "third resistor".

In this example, the resistors are set in the voltage divider circuit 406 as represented by the following expressions (4) and (5).

$$\text{Resistor } 422 + \text{resistor } 423 = \text{resistor } 222 \quad (4)$$

$$\text{Resistor } 423 = \text{resistor } 323 \quad (5)$$

With this setting, when the voltage regulator 401 is on, the voltage dividing ratio of the voltage divider circuit 406 is the same as that of the voltage divider circuit 306 in the first structural example. In addition, because the impedance of the resistor 423 is set to be small as in the resistor 323 shown in FIG. 3, even if the leak current of the output circuit 308 increases at a high temperature, the voltage regulator 401 can turn off without any problems as in the voltage regulator 301.

Further, in the voltage divider circuit 406, at the time of turning off, because pull-down is made from an arbitrary middle point of the voltage divider resistor, the resistor 423 can serves as the voltage dividing function at the time of the on state and the pull-down function at the time of the off state. Therefore, the voltage regulator 401 can reduce the circuit area as large as the resistor 323 as compared with the voltage regulator 301. It is needless to say that the resistor 422 and the resistor 423 can be freely adjusted according to an intended use.

Figure 5:
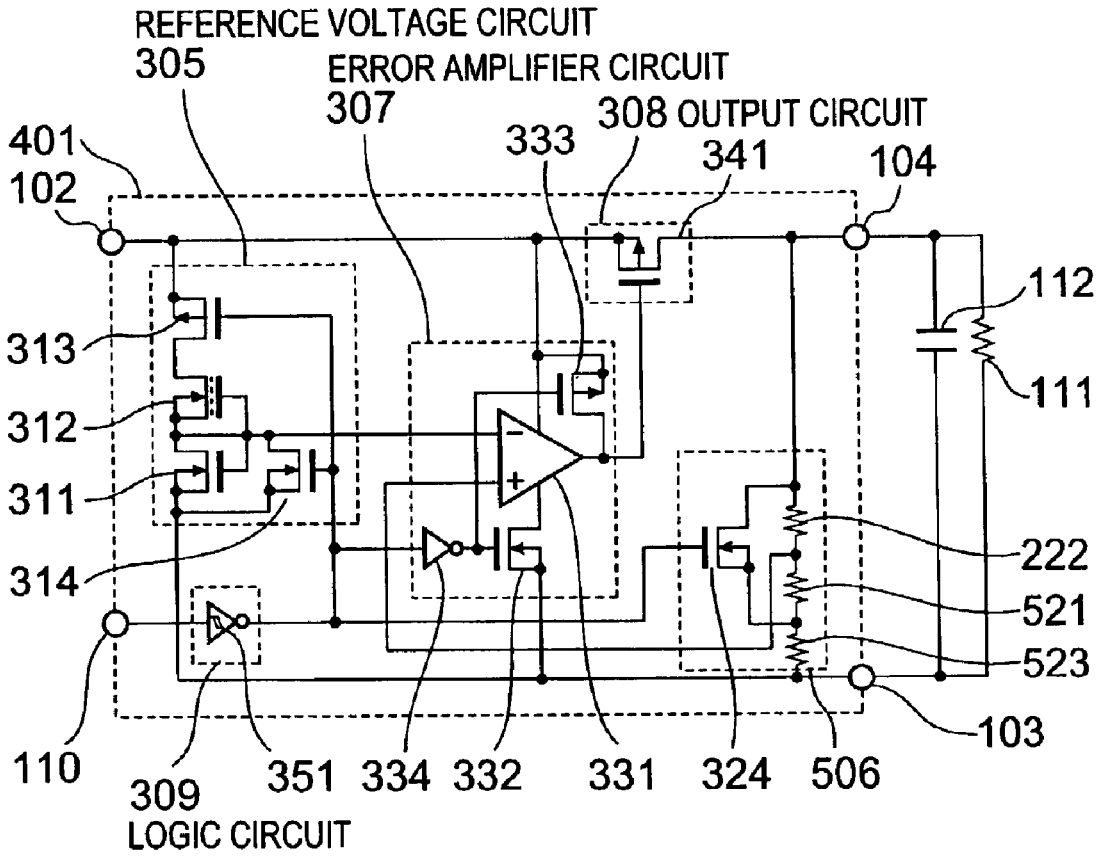
FIG. 5 is a circuit block diagram showing yet still another structural example of a voltage regulator in accordance with the present invention.

In this example, referring to FIG. 4, the resistor 423 is connected between the drain terminal of the enhancement NMOS transistor 324 and the output voltage terminal 104. Instead of the resistor 423, the resistor 523 is connected between the source terminal of the enhancement NMOS transistor 324 and the GND terminal 108 as shown in FIG. 5. Even if the resistance of the voltage divider circuit 506 is set as represented by the following expressions (6) and (7), the same effect can be obtained.

$$\text{Resistor } 523 = \text{resistor } 323 \quad (6)$$

$$\text{Resistor } 523 + \text{resistor } 521 = \text{resistor } 221 \quad (7)$$

In this embodiment, the positive voltage output voltage regulator based on the GND is disclosed. However, the same effect can be obtained even if a negative voltage output voltage regulator or a VDD based voltage regulator may be employed.

Also, in this embodiment, the CMOS transistor circuit is disclosed. However, it is apparent that a bipolar transistor circuit or other circuit types are applicable to the present invention, and the present invention is not limited to or by this embodiment.

As was described above, in the voltage regulator according to the present invention, since the impedance of the voltage divider circuit is decreased when the voltage regulator turns off, the voltage regulator can turn off without any problems even under the circumstances in which the temperature is high and the impedance of the external load is large. For that reason, the external load does not consume the power wastefully, and the power consumption of a system using the voltage regulator of the present invention can be saved. Also the appropriate adjustment of the impedance can prevent the voltage regulator from being broken by allowing a large current to flow in the transistor that pulls down from the output capacitor. In addition, an turn-off speed can be freely adjusted by adjusting the impedance of the pull-down resistor and the output capacitor, and the present invention can be adapted to various applications. Further, since pull-down is made from an arbitrary middle point of the voltage dividing resistor that constitutes the voltage divider circuit, the same resistor can have the voltage dividing function at the time of on and the pull-down function at the time of off, thereby being capable of reducing the circuit area.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A voltage regulator for converting an input voltage into a regulated output voltage, comprising: external connection terminals including an output voltage terminal for outputting the regulated output voltage, a reference terminal, and a control signal input terminal for inputting a control signal; a voltage divider circuit for dividing the regulated output voltage and outputting a divided voltage; an error amplifier controlled by the control signal for comparing the divided voltage with a reference voltage and controlling a level of the regulated output voltage based on the comparison result when the control signal has a first value; a transistor connected in parallel with the voltage divider circuit; and a resistor connected in series to the transistor and having a resistance value smaller than that of the voltage divider circuit so that the transistor is turned on when the control signal has a second value so as to pull down the voltage at the output terminal to the reference terminal through the voltage divider circuit.

2. A voltage regulator circuit comprising: external connection terminals including an input voltage terminal for receiving an input voltage, an output terminal for outputting a regulated output voltage, a reference potential terminal, and a control terminal for inputting a control signal; an output circuit connected to the output terminal and having a variable impedance value; a reference voltage generating circuit for generating a reference voltage; a voltage divider circuit for dividing the output voltage and outputting a divided voltage; an error amplifier circuit for comparing the divided voltage and the reference voltage and adjusting the impedance of the output circuit based on the comparison result so that the divided voltage becomes equal to the reference voltage when the control signal has a first value; a logic circuit connected to the control terminal for controlling the error amplifier circuit to increase the impedance of the output circuit when the control signal has a second value; and a transistor connected in series to a resistor having a resistance value smaller than that of the voltage divider circuit, the transistor being connected in parallel with the voltage divider circuit and being turned on when the control signal has the second value so that the output terminal is pulled down to the reference potential terminal through the impedance of the voltage divider circuit.

3. A voltage regulator circuit comprising: external connection terminals including an input voltage terminal for receiving an input voltage, an output voltage terminal for outputting a regulated output voltage, a reference potential terminal, and a control terminal for inputting a control signal; an output circuit connected to the output terminal and having a variable impedance value; a reference voltage generating circuit for generating a reference voltage; a voltage divider circuit for dividing the output voltage and outputting a divided voltage; an error amplifier circuit for comparing the divided voltage and the reference voltage and adjusting the impedance of the output circuit based on the comparison result so that the divided voltage becomes equal to the reference voltage when the control signal has a first value; a logic circuit connected to the control terminal for controlling the error amplifier circuit when the control signal has a second value to increase the impedance of the output circuit; a resistor connected in series to the voltage divider circuit and having a resistance value smaller than that of the voltage divider circuit; and a transistor connected in parallel with the voltage divider circuit, the transistor being turned on when the control signal has the second value so that the output terminal is pulled down to the reference potential terminal through the impedance of the voltage divider circuit.

* * * * *